US011145454B2

(12) United States Patent
Fontaine et al.

(10) Patent No.: US 11,145,454 B2
(45) Date of Patent: Oct. 12, 2021

(54) ELECTRICAL TRANSFORMER WITH WINDINGS

(71) Applicant: SAFRAN ELECTRONICS & DEFENSE, Boulogne-Billancourt (FR)

(72) Inventors: Sébastien Fontaine, Paris (FR); Daniel Sadarnac, Solignac (FR); Charif Karimi, Orsay (FR)

(73) Assignee: SAFRAN ELECTRONICS & DEFENSE, Boulogne-Billancourt (FR)

( * ) Notice: Subject to any disclaimer, the term of this patent is extended or adjusted under 35 U.S.C. 154(b) by 531 days.

(21) Appl. No.: 16/090,407

(22) PCT Filed: Mar. 27, 2017

(86) PCT No.: PCT/EP2017/057219
§ 371 (c)(1),
(2) Date: Feb. 4, 2019

(87) PCT Pub. No.: WO2017/167699
PCT Pub. Date: Oct. 5, 2017

(65) Prior Publication Data

US 2019/0385782 A1 Dec. 19, 2019

(30) Foreign Application Priority Data

Mar. 30, 2016 (FR) ..... 1652755

(51) Int. Cl.
*H01F 27/28* (2006.01)

(52) U.S. Cl.
CPC ..... *H01F 27/2823* (2013.01)

(58) Field of Classification Search
CPC .. H01F 27/2823; H01F 38/18; H01F 27/2871; H01F 27/346; H01F 27/38
(Continued)

(56) References Cited

U.S. PATENT DOCUMENTS 5,572,178 A 11/1996 Becker et al.
5,608,771 A 3/1997 Steigerwald et al.
(Continued)

OTHER PUBLICATIONS

Communication dated Oct. 21, 2016 from the French Patent Office in counterpart Application No. FR1652755.
(Continued)

*Primary Examiner* — Shawki S Ismail
*Assistant Examiner* — Kazi S Hossain
(74) *Attorney, Agent, or Firm* — Sughrue Mion, PLLC

(57) ABSTRACT

The invention relates to an electrical transformer (T, T') comprising: a primary central winding (11*a*) extending around an axis (X) and configured to generate a central magnetic flux when a current is passed through it circulating in a first direction around the axis (X), two peripheral primary windings (12*a*, 13*a*) extending around the axis (X), between which the central primary winding (11*a*) is located, and configured to generate peripheral magnetic fluxes when currents are passed through same respectively circulating in a second direction around the axis (X) which is opposite to the first direction, the peripheral magnetic fluxes superimposing on the central magnetic flux, wherein the windings are further configured in such a way that the peripheral magnetic fluxes compensate the central magnetic flux in the regions located beyond the peripheral windings.

13 Claims, 10 Drawing Sheets

(58) Field of Classification Search
USPC ..... 336/220, 120
See application file for complete search history.

(56) References Cited

U.S. PATENT DOCUMENTS

| | | | | |
|---|---|---|---|---|
| 7,197,113 | B1 * | 3/2007 | Katcha | A61B 6/032 378/101 |
| 7,274,281 | B2 * | 9/2007 | Sugioka | H01F 27/2823 336/170 |
| 9,754,716 | B2 * | 9/2017 | Mumford | H01F 6/06 |
| 2004/0251999 | A1 * | 12/2004 | Darmann | H01F 36/00 336/180 |
| 2010/0164673 | A1 * | 7/2010 | Shim | H01F 27/36 336/221 |

OTHER PUBLICATIONS

International Search Report with Written Opinion dated Jun. 19, 2017, issued by the International Searching Authority in application No. PCT/EP2017/057219.
International Search Report for PCT/EP2017/057219 dated Jun. 19, 2017 [PCT/ISA/210].

* cited by examiner

ELECTRICAL TRANSFORMER WITH WINDINGS

This Application is a National Stage of International Application No. PCT/EP2017/057219 filed Mar. 27, 2017, claiming priority based on French Patent Application No. 1652755 filed Mar. 30, 2016, the entire contents of each of which are herein incorporated by reference in their entireties.

FIELD OF THE INVENTION

The invention relates to an electrical transformer with windings.

PRIOR ART

The prior art discloses electrical transformers comprising two parts, in which power must be transmitted from one of the two parts to the other part.

For this reason, a known transformer comprises at least two windings: a primary winding, generally connected to a power supply source, and a secondary winding generally connected to a "charge" which it supplies with power drawn from the source.

FIGS. 1*a* and 1*b* illustrate two conventional electrical transformers, in which the primary winding P comprises $n_1$ turns extending around an axis X, and the secondary winding S comprises $n_2$ turns extending around the axis X and around $n_1$ turns.

In such transformers, power is transmitted from the primary winding P to the secondary winding S via a magnetic flux radiated by the primary winding P and in part received by the secondary winding S. A magnetic circuit M, constituted by material with strong magnetic permeability such as ferrite, is used to convey this magnetic flux and improve coupling between the windings. The magnetic circuit M of the transformer of FIG. 1*a* has a cross-section in the form of a disc in a plane transversal to the axis X, while that of the transformer of FIG. 1*b* has an annular cross-section in such a plane.

Currents $i_1$ and $i_2$ pass through the windings P and S, as shown in FIG. 1. When the permeability of the magnetic circuit M is sufficient, the "amperes x turns" of the primary winding and of the secondary winding are almost identical, as the following formula illustrates:

$$n1i1 \approx n2i2$$

But the magnetic circuit adds weight to the electrical transformer.

Also, in some electrical transformers, it is preferable that the power is transmitted from one part to the other without contact between the two parts. This is the case especially of transformers known as "turning" or "rotary", which are characterized by primary and secondary windings mobile relative to each other.

An example of a known turning transformer is illustrated in FIG. 2*a*. FIG. 2*b* per se illustrates a non-conventional transformer which could be theoretically possible in an approach to alleviate and simplify the geometry of the pieces. These transformers comprise an airgap e, specifically a space formed in the magnetic circuit such that one winding can turn relative to the other. Connection wires turn in this space e if the two parts of the magnetic circuit are fixed (only one winding turns). This space corresponds to the mechanical play necessary if the two parts of the magnetic circuit are each fixed to a winding (a winding turns with a part of the magnetic circuit). Now, due to the presence of the airgap e, the magnetic flux between the two windings P and S is less well channelled. This results in a noticeable difference between the "amperes x turns" of the primary winding and of the secondary winding:

$$n1i1 \neq n2i2$$

This difference occurs in the magnetic environment of the system. It is possible to rewrite the preceding equation by defining "the magnetizing current" im1 seen by the primary winding:

$$n1i1 = n2i2 + n1im1$$

A classic magnetic circuit M is not a linear system. However, given the airgap e, it is possible to consider the overall system as almost linear, which utilises the theorem of superposition: the magnetic environment can be considered as the sum of the two radiations emitted by the windings in the two configurations following:

- $1^{st}$ configuration: there are identical "amperes x turns" n1 i1=n2 i2 (imposed by the charge)
- $2^{nd}$ configuration: only the winding is supplied by the magnetizing current: n1 i1=n1 im1 (calculable from the voltage imposed by the source).

In the $1^{st}$ configuration, the effects of the two windings P, S are compensated around the system. All the magnetic fluxes are practically contained in the system. Magnetic leaks to the outside of the transformer are limited. FIG. 3 illustrates this compensation effect. The left part of FIG. 3 shows a single conductor in the space, rectilinear and of infinite length: the circular induction lines with induction decreasing inversely proportional to the distance radial to this conductor. The central part of FIG. 3 shows the association of two such conductors, arranged parallel and through which currents of opposite direction pass.

Their effects are superposed in the right part of FIG. 3: the induction is reinforced between the conductors while it decreases very quickly to the exterior, as they move away from the conductors. Portions of magnetic circuit placed around the conductors suffice in this $1^{st}$ configuration to channel these low fluxes of external leak.

FIGS. 4*a* and 4*b* show the magnetic fluxes generated by the transformers of FIGS. 2*a* and 2*b* in the $2^{nd}$ configuration (the sole current imposed on the transformer is the magnetizing current in the primary winding). In this $2^{nd}$ configuration, there is no more compensation effect. Magnetic leaks spread towards the exterior of these transformers, the leaks being as large as the airgaps e are wide.

FIG. 5 details the profile of the induction obtained along the straight line D of the transformer of FIG. 4*b* for a given magnetizing current imposed on the primary winding. This figure translates the presence of magnetic leaks to the exterior of the transformer. Inside the transformer, the induction profile is calculable simply by approximating the induction lines internal to parallel straight lines: the two lines traced according to a thicker line in this figure enclose some of the "amperes x turns"; the induction on these two lines is proportional to these encircled "amperes x turns". The fact that the induction is not zero along the straight line D in regions adjoining the transformer is the manifestation of the above magnetic leaks.

Now, these magnetic leaks are likely to disrupt the operation of other components located near the transformer or outside the system wherein the latter is implanted.

Also, even if the magnetic circuit M can contribute to reducing these magnetic leaks, this magnetic circuit remains an imperfect solution for eliminating them in the case of an electrical transformer whereof the two parts do not touch, such as a transformer of rotary type, since an airgap e remains.

Also, as indicated previously, the magnetic circuit adds weight to the electrical transformer.

SUMMARY OF THE INVENTION

An aim of the invention is to reduce the magnetic perturbations generated by a transformer operating based on windings, while significantly lightening this transformer.

To achieve this aim the invention proposes an electrical transformer comprising:

- a primary central winding extending around an axis and configured to generate a central magnetic flux, when a turning current passes through it according to a first direction around the axis,
- two primary peripheral windings extending around the axis, between which the primary central winding is located, and configured to generate central magnetic fluxes when respective turning currents pass through them according to a second direction around the axis which is opposite the first direction, the central magnetic fluxes superposing on the central magnetic flux,
- wherein the windings are also configured such that the central magnetic fluxes compensate the central magnetic flux in regions located beyond the peripheral windings.

In the transformer as proposed, a magnetic flux compensation phenomenon is obtained by adding peripheral windings on either side of the primary winding. This compensation reduces or even eliminates magnetic leaks in the peripheral regions of the transformer without necessarily having to integrate a magnetic circuit likely to add weight to the transformer.

The invention can also be completed by the following characteristics, taken singly or in combination when this is technically possible.

- The primary windings are mounted in series.
- The primary central winding is wound around the axis according to a first winding direction, and the primary peripheral windings are wound around the axis according to a second winding direction opposite the first winding direction.
- The primary peripheral windings together have an accumulated number of turns equal to the number of turns of the primary central winding.
- Each primary winding has at least one helicoidal part around and along the axis, the helicoidal parts of the three primary windings extending in ranges of different respective positions along the axis.
- The transformer also comprises a magnetic circuit presenting two opposite ends having different longitudinal positions in a direction parallel to the axis, and the primary windings are strictly confined between and at a distance from these two longitudinal positions.
- Each primary winding has at least one part in a spiral wound on itself transversally to the axis, the parts in a spiral of the three primary windings extending in ranges of different respective annular positions relative to the axis.
- The primary windings are coplanar.
- The transformer also comprises a magnetic circuit presenting two opposite ends having different radial positions in a direction perpendicular to the axis, and the primary and secondary windings are strictly confined between and at a distance from these two radial positions.
- The electrical transformer also comprises a secondary central winding configured to receive at least in part the central magnetic flux.
- The electrical transformer also comprises two secondary peripheral windings, between which the secondary central winding is located, each secondary peripheral winding being configured to receive at least partially one of the central magnetic fluxes.
- The transformer comprises a primary casing to which each primary winding is fixed, and a secondary casing to which the or each secondary winding is fixed, the two casings being mobile in rotation relative to each other relative to the axis.
- The transformer comprises a primary casing presenting a primary annular surface extending perpendicularly to the axis, each primary winding being fixed on the primary annular surface, a secondary casing presenting a secondary annular surface extending perpendicularly to the axis and facing the primary annular surface, each secondary winding being fixed on the secondary annular surface so as to be opposite a primary winding.

DESCRIPTION OF FIGURES

Other characteristics, aims and advantages of the invention will emerge from the following description which is purely illustrative and non-limiting and which must be considered with respect to the appended drawings, in which.

In all figures, similar elements bear identical reference numerals.

DETAILED DESCRIPTION OF THE INVENTION

Figure 1B:
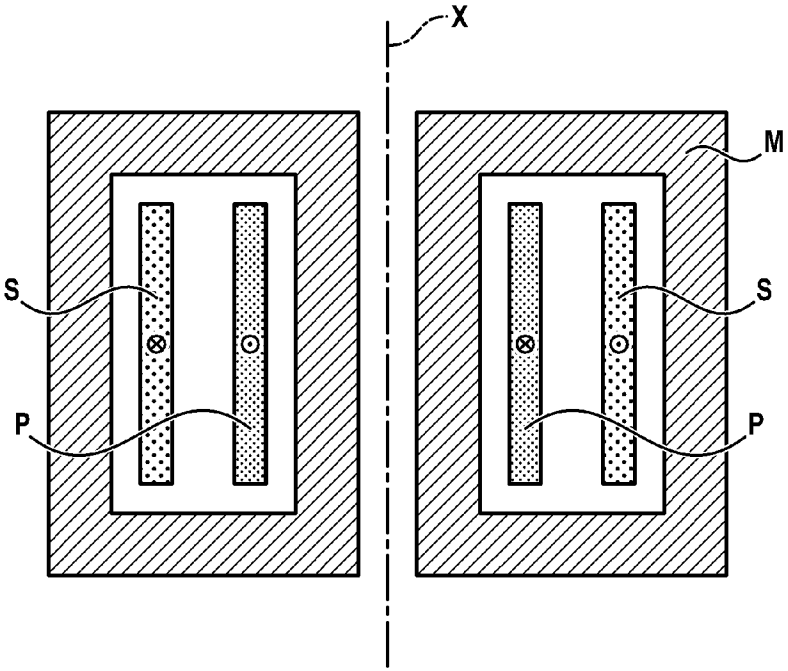
Prior Art FIG. 1b
FIGS. 1*a*, 1*b*, 2*a*, 2*b* are sectional views of three transformers with conventional windings.
Figure 1A:
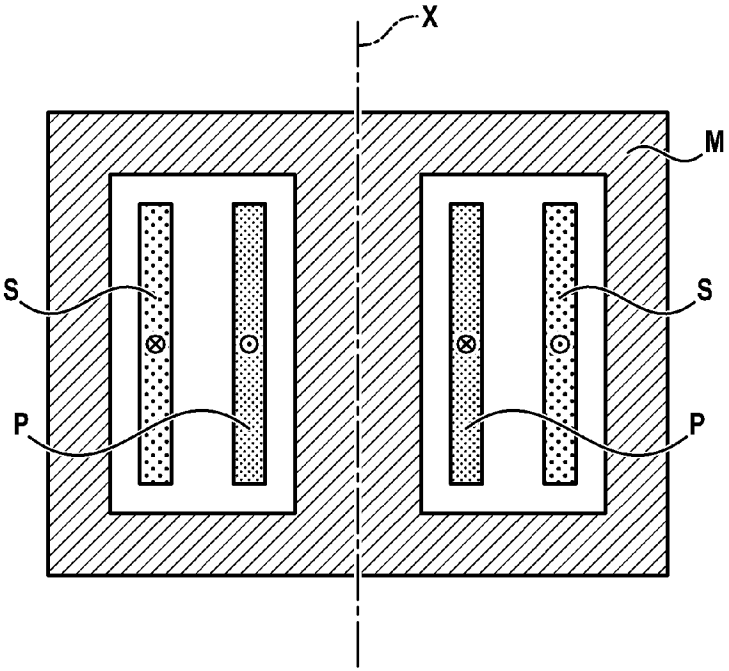
Prior Art FIG. 1a
Figure 2B:
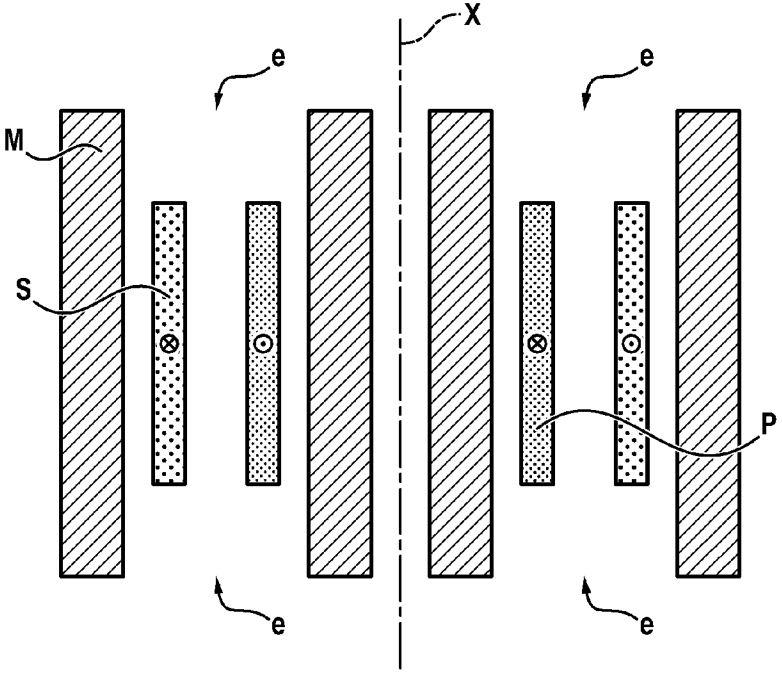
Prior Art FIG. 2b
Figure 2A:
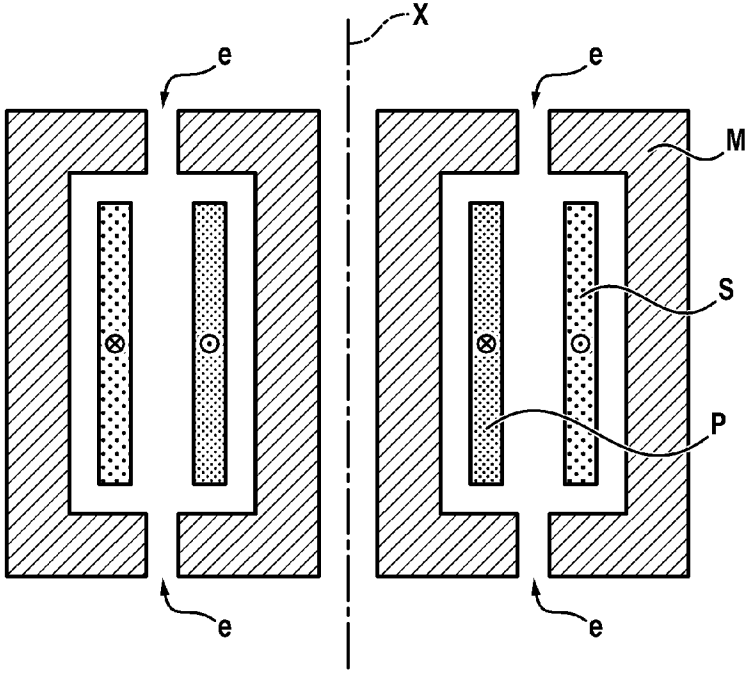
Prior Art FIG. 2a
Figure 3:
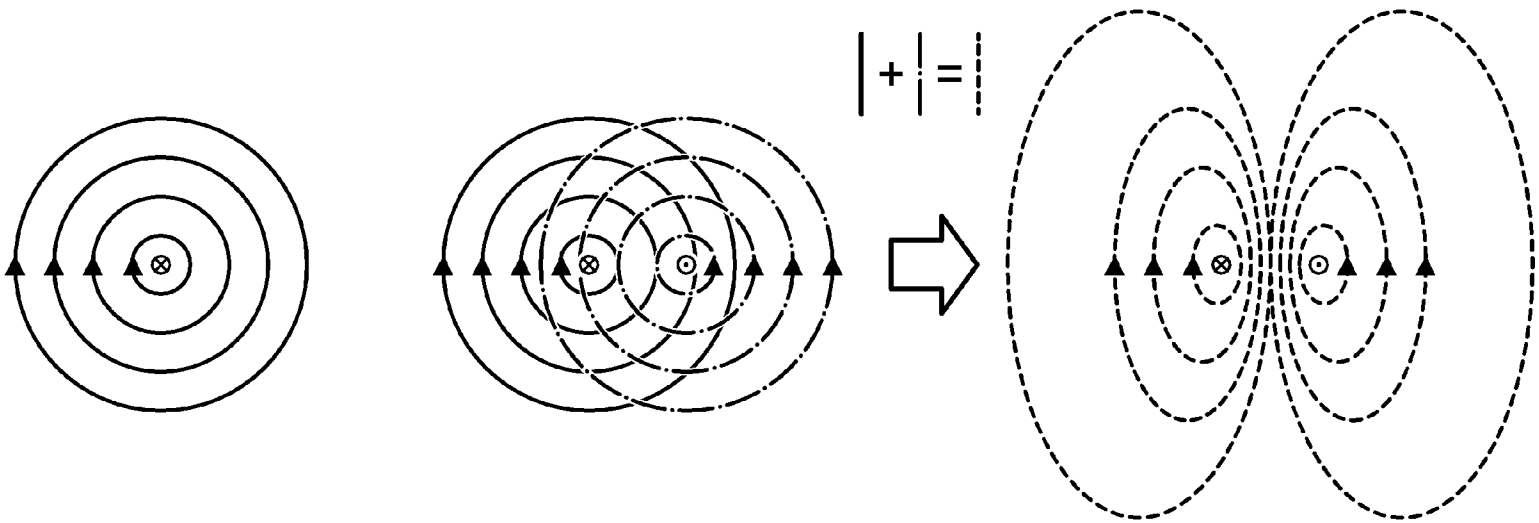
FIG. 3 Prior Art
FIG. 3 schematically illustrates the superposition of two magnetic fluxes generated by two rectilinear conductors.
Figure 4B:
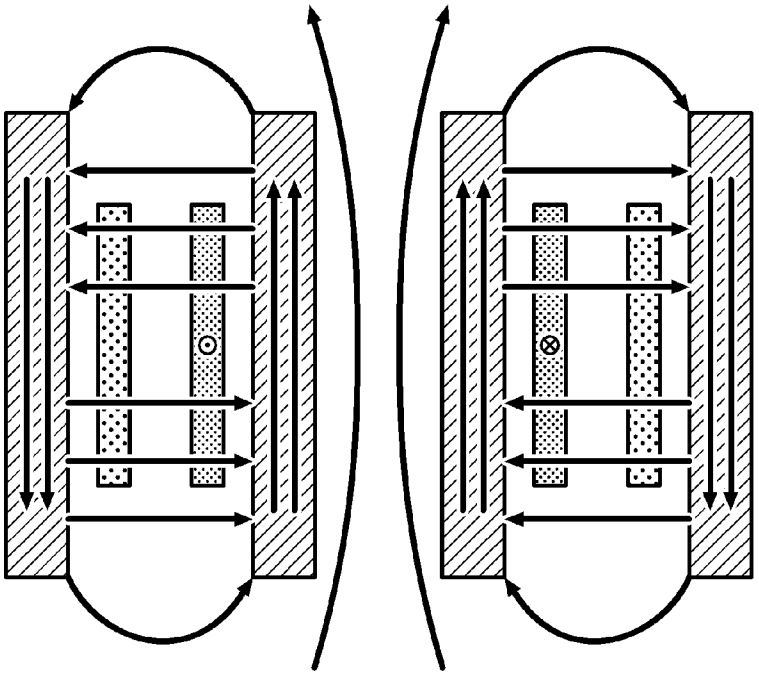
Prior Art FIG. 4b
FIGS. 4*a*, 4*b* illustrate lines of magnetic fluxes generated by the transformers of FIGS. 2*a* and 2*b* respectively.
Figure 4A:
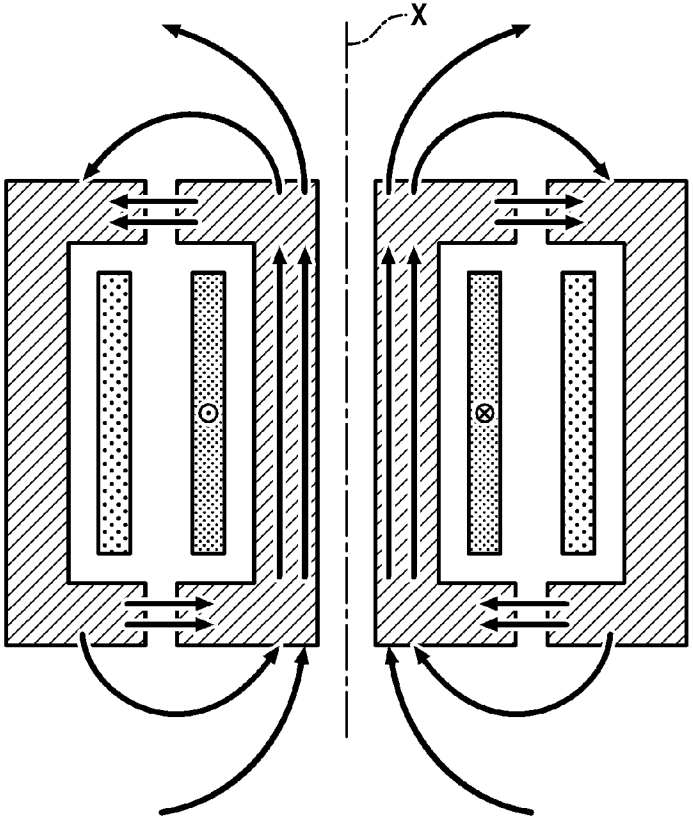
Prior Art FIG. 4a
Figure 5:
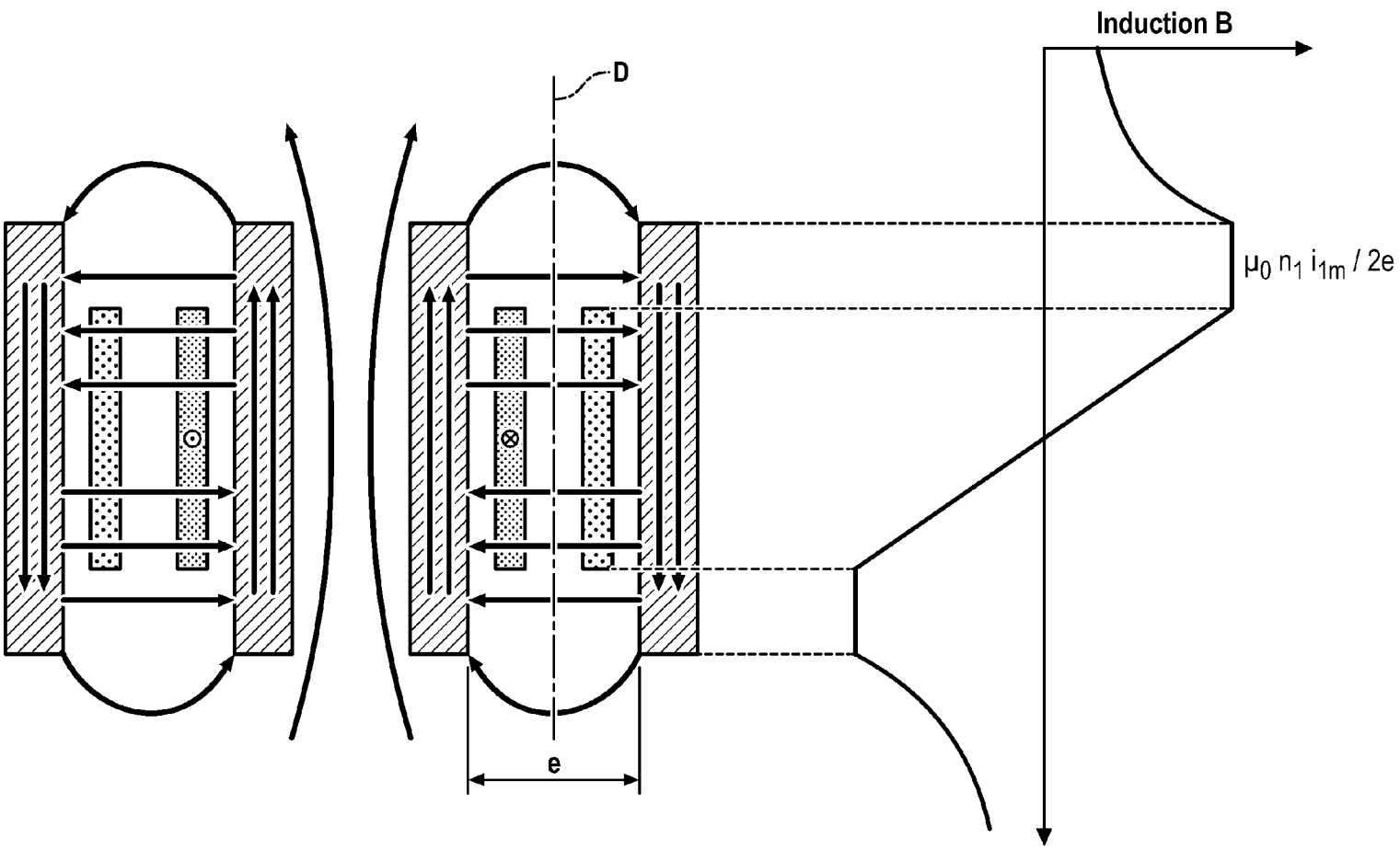
Prior Art FIG. 5
FIG. 5 comprises a sectional view of the transformer of FIG. 4*b* in association, and an induction profile obtained when this transformer is supplied with current.
Figure 6:
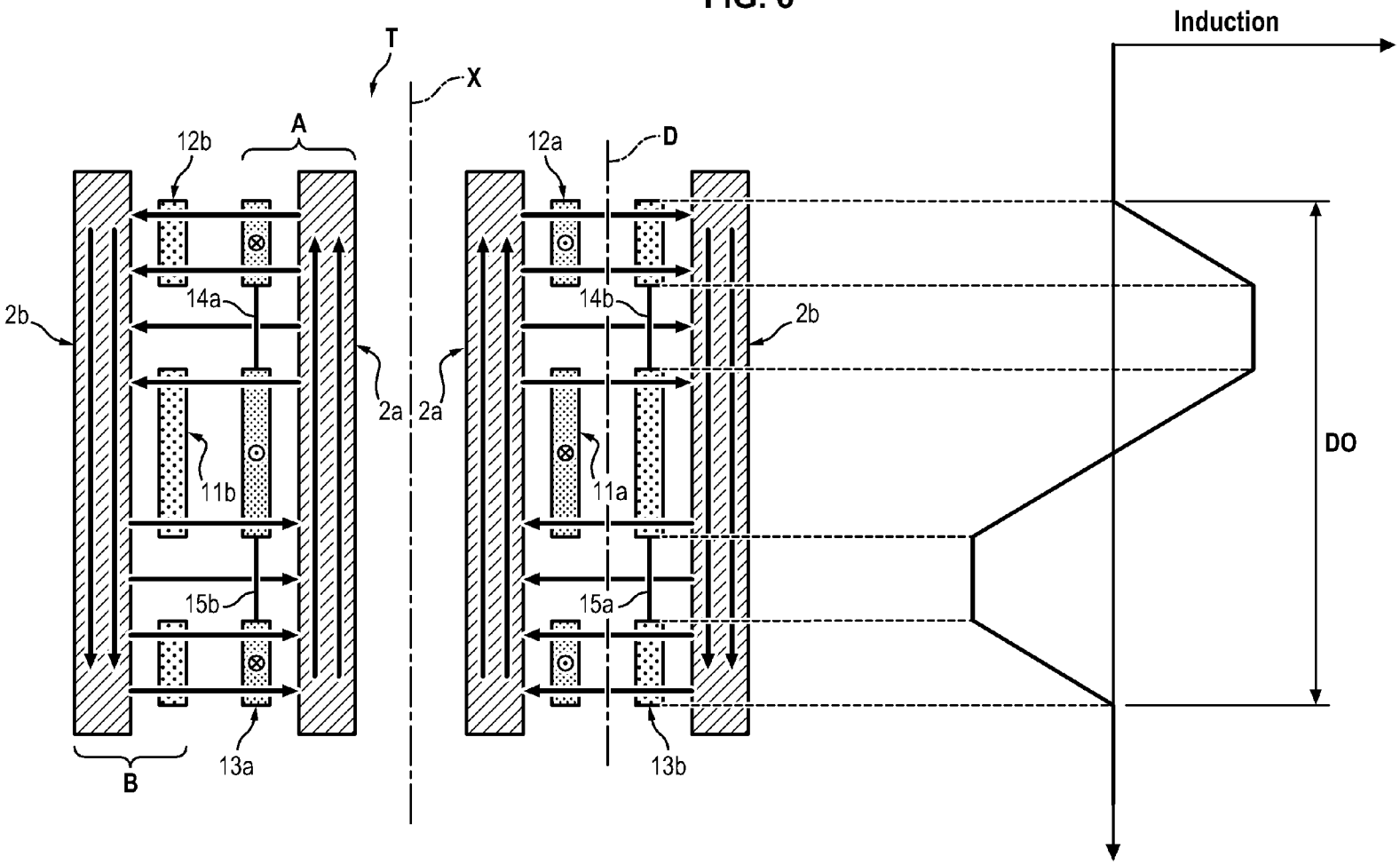
FIG. 6 comprises a sectional view of a transformer according to a first embodiment of the invention, and an induction profile along a straight line D obtained when the transformer is supplied with current.

In reference to the left part of FIG. 6, a transformer T comprises two parts: a primary part A and a secondary part B.

In the present text below, an element relating to part A will be qualified as "primary" and designated in the figures by a reference suffixed by "a"; similarly, an element relating to part B will be qualified as "secondary" and designated in the figures by a reference suffixed by "b".

The primary part A comprises three primary windings 11*a*, 12*a*, 13*a* and the part secondary B comprises three secondary windings 11*b*, 12*b*, 13*b*.

Even though this does not appear in the figures, which are schematic only, each winding mentioned in the present document comprises one or more turns. A turn is defined as a winding part extending 360 degrees around an axis in a given direction. Formally, a "winding" is defined hereinbelow as a turn or a set of consecutive turns wound in the same direction. As a consequence, a change in direction marks a separation between two adjacent windings.

The six windings 11*a*, 12*a*, 13*a*, 11*b*, 12*b*, 13*b* extend around a reference axis X.

The primary winding 11*a*, called primary central winding, is arranged between the primary windings 12*a* and 13*a*, called primary peripheral windings.

The primary windings 11*a*, 12*a*, 13*a* are intended to be connected to one or more electrical power sources (not shown in the figures). These primary windings 11*a*, 12*a*, 13*a* are therefore supplied with current by such electrical sources.

The primary central winding 11*a* is configured for a turning current to pass through according to a first direction around the axis X. The two primary peripheral windings 12*a*, 13*a* are configured for a turning current to pass through according to a second direction around the axis X which is opposite the first direction. In other words, the directions of travel of the current in the different primary windings alternate.

The three primary windings 11*a*, 12*a*, 13*a* can be mounted in series, that is, they form different portions of the same primary electrical conductor. In this way, a current of the same intensity can pass through the primary windings, for example provided by a single power source.

Alternating the direction of currents passing through the three primary windings 11*a*, 12*a*, 13*a* can for example be obtained by alternating the direction wherein these windings 11*a*, 12*a*, 13*a* are wound around the axis X. The primary peripheral windings 12*a*, 13*a* are wound around the axis X according to a first winding direction (for example clockwise), and the primary central winding 11*a* is wound around the axis X according to a second winding direction opposite the first winding direction (anti-clockwise). This is capable of minimizing the length of conductor necessary for connecting the primary central winding to each of the primary peripheral adjacent windings, when the latter are mounted in series.

In this case, the primary central winding 11*a* and the primary peripheral winding 12*a* are directly connected to each other via a junction 14*a* forming a hairpin: it is in the region of this junction 14*a* where the winding direction around the reference axis X reverses between the two primary windings 11*a* and 12*a*. The same applies for the junction 15*a* between the windings 11*a* and 13*a*.

The three windings can be contiguous in pairs. In other terms, the windings are in contact two by two (the junctions 14*a* and 15*a* can form a simple fold).

Alternatively, the three primary windings are at a distance from each other; in this case the junction 14*a* traverses a space between the two windings 11*a* and 12*a*, and the junction 15*a* traverses a space between the two windings 11*a* and 13*a*. This space is useful (but not indispensable) for maximizing the magnetic flux closing up via the primary and secondary windings, therefore for maximizing the resulting magnetisation inductance. The maximisation of the magnetisation inductance is useful (but non indispensable) for minimizing the vacuum current (without charge) of the transformer.

Also, the primary peripheral windings 12*a*, 13*a* of FIG. 6 comprise the same number of turns and together have an accumulated number of turns equal to the number of turns of the primary central winding 11*a*.

Similarly, the secondary winding 11*b*, called secondary central winding, is arranged between the secondary windings 12*b* and 13*b*, called secondary peripheral windings.

The secondary windings 11*b*, 12*b*, 13*b* are intended to be attached to one or more electrical devices to be powered, also designated as "charges" (not shown in the figures).

The primary central winding 11*a* is configured to generate a central magnetic flux cooperating with the secondary central winding 11*b*. The primary peripheral winding 12*a* (respectively 13*a*) is configured to generate a central magnetic flux cooperating with the secondary winding 12*b* (respectively 13*b*).

The secondary central winding 11*b* is configured so that a turning current passes through it according to the second direction around the axis X (therefore according to a direction opposite the direction of the turning current in the primary central winding 11*a* with which it cooperates). The two secondary peripheral windings 12*b*, 13*b* are configured such that a turning current passes through them according to the first direction around the axis X which is opposite the second direction. In other words, the direction of travel of the current in the different secondary windings 11*b*-13*b* also alternate.

The three secondary windings 11*b*, 12*b*, 13*b* can be mounted in series, that is, they form different portions of the same secondary electrical conductor.

Alternating the direction of currents passing through the three secondary windings 11*b*, 12*b*, 13*b* can for example be achieved by alternating the direction wherein these windings are wound around the axis X. The secondary peripheral windings 12*b*, 13*b* are wound around the axis X according to a certain winding direction (for example anti-clockwise), and the secondary central winding 11*b* is wound around the axis X according to the other direction (for example clockwise).

In this case, the secondary central winding 11*b* and the secondary peripheral winding 12*b* are directly connected to each other, via a junction 14*b* forming a hairpin: it is in the region of this junction 14*b* where the winding direction around the reference axis X reverses between the two secondary windings 11*b* and 12*b*. Similarly, the secondary central winding 11*b* and the secondary winding 13*b* are directly connected to each other, via another junction 15*b* forming a semi-turn: it is in the region of this junction 15*b* where the winding direction around the reference axis X reverses between the two secondary windings 11*b* and 13*b*.

Also, the secondary peripheral windings 12*b*, 13*b* of FIG. 6 comprise the same number of turns and together have an accumulated number of turns equal to the number of turns of the secondary central winding 11*b*.

A number n of turns in the primary windings and m turns in the secondary windings can be provided, distributed as follows: n/4 turns for each of the primary peripheral windings, n/2 turns for the primary central winding, m/4 turns for each of the secondary peripheral windings and m/2 turns for the secondary central winding. For example, there can be n=m or n different to m (in which case the transformer will have a different transformation ratio of 1).

In a particularly advantageous application, the transformer is of rotary type, in the sense that the primary windings 11*a*, 12*a*, 13*a* are mobile in rotation around the axis X relative to the secondary windings 11*b*, 12*b*, 13*b* (or inversely).

The primary part A of the transformer is for example a stator comprising a primary casing 2*a* extending around the reference axis X. The primary casing 2*a* has an overall annular shape, for example cylindrical and/or revolution.

The part secondary B is also a rotor in rotation around the reference axis X relative to the stator A. The rotor B comprises a secondary casing 2*b* presenting an overall annular shape, for example cylindrical and/or revolution.

The secondary casing 2*b* is inside the primary casing 2*a*, or vice-versa. In the figures, the casing nearest the axis X is hollow; it is understood that this casing can alternatively be full.

The primary windings are fixed to the stator A, and the secondary windings are fixed to the rotor B.

In the following, two different embodiments will be detailed, each comprising the characteristics discussed previously.

Embodiment with "Cylindrical" Windings

The left part of FIG. 6 schematically illustrates an embodiment of a transformer T, known as with "cylindrical" windings, wherein each winding extends in volume around and along the axis X. More precisely, each winding comprises a succession of turns located in different positions along the reference axis X (for better legibility, FIG. 6 shows just one turn of each primary winding).

The primary conductor wherein the primary windings are formed is wound according to a substantially helicoidal trajectory around and along the axis X, and occupies a volume overall annular centred on the reference axis X. The primary windings are wound at a first radial distance of the reference axis X.

In this embodiment, the junction 14*a* between the primary peripheral winding 12*a* and the primary central winding 11*a* is a portion of the primary conductor which is confined between the two windings 11*a*, 12*a* in a direction parallel to the axis X. The same applies for the junction 15*a* which connects the primary windings 11*a* and 13*a*.

The above characteristics also apply to the secondary conductor, wherein the secondary windings 11*b*, 12*b*, 13*b* and the junctions 14*b*-15*b* are formed. This conductor secondary is wound according to a substantially helicoidal trajectory around and along the axis X, and occupies a volume overall annular centred on the reference axis X. The secondary windings 11*b*, 12*b*, 13*b* are wound at a second radial distance of the reference axis X, different of the first radial distance.

For example, the secondary windings 11*b*, 12*b*, 13*b* are wound around primary windings 11*a*, 12*a*, 13*a* relative to the axis X, or vice-versa. More precisely, each secondary winding is wound around a primary winding, and opposite the latter.

The transformer T with "cylindrical" windings can be of rotary type. The windings radially further away from the axis X can be fixed to the external annular casing 2*b*, and the windings radially closer to the axis X can be fixed to the internal annular casing 2*a* as illustrated in FIG. 6, the two casings being mobile in rotation relative to each other.

When the primary windings 11*a*, 12*a*, 13*a* are supplied with current, it is possible in first approximation to consider that each of these windings creates a magnetic flux, with all three fluxes being superposed to form the resulting overall flux. This is how the induction lines in the left part of FIG. 6 and the induction profile in the right part can be traced.

The left part of FIG. 6 shows the induction lines which result from the magnetizing current circulating in the primary conductor in the transformer with cylindrical windings T, and the right part of FIG. 6 shows the induction profile measured along a straight line D parallel to the axis X and located between the annular structure formed by the primary windings and the annular structure formed by the secondary windings.

Three regions of space are distinguished: a central region centred near the central windings 11*a* and 11*b*, containing a segment DO of the straight line D, and two peripheral regions, containing the two remaining semi-straight lines of the straight line D.

In the central region, power is transferred from the primary windings to the secondary windings.

The secondary central winding 11*b* receives at least in part the central magnetic flux generated by the primary central winding 11*a*, the peripheral secondary winding 12*b* (respectively 13*b*) receives the peripheral magnetic flux generated by the primary peripheral winding 12*a* (respectively 13*a*).

A tension is generated in the secondary windings connected to the charge or the charges used. A turning current passes through the secondary central winding 11*b* according to a third direction around the axis X, and a turning current passes through the two secondary peripheral windings 12*b*, 13*b* according to a fourth direction around the axis X which is opposite the third direction. In other words, the directions of travel of the current in the different secondary windings 11*b*, 12*b*, 13*b* alternate, as is the case for the primary conductors 11*a*, 12*a*, 13*a*. Irrespective of the type of charge, in the peripheral regions, the central magnetic fluxes created by the primary peripheral windings 12*a*, 13*a*, compensate the effects of the central magnetic flux engendered by the primary central winding 11*a*. By way of example, the induction is in particular zero along the two semi-straight lines of the straight line D starting from the two opposite ends of the segment DO. Items of equipment located in these peripheral regions, and in particular located along the straight line D or of the axis X are therefore protected highly efficiently from radiation emitted by the windings of the transformer, and without there being a need to resort to a magnetic circuit weighing down the transformer or complicating its form with the aim of minimizing the airgap discussed in the introduction.

Figure 7A:
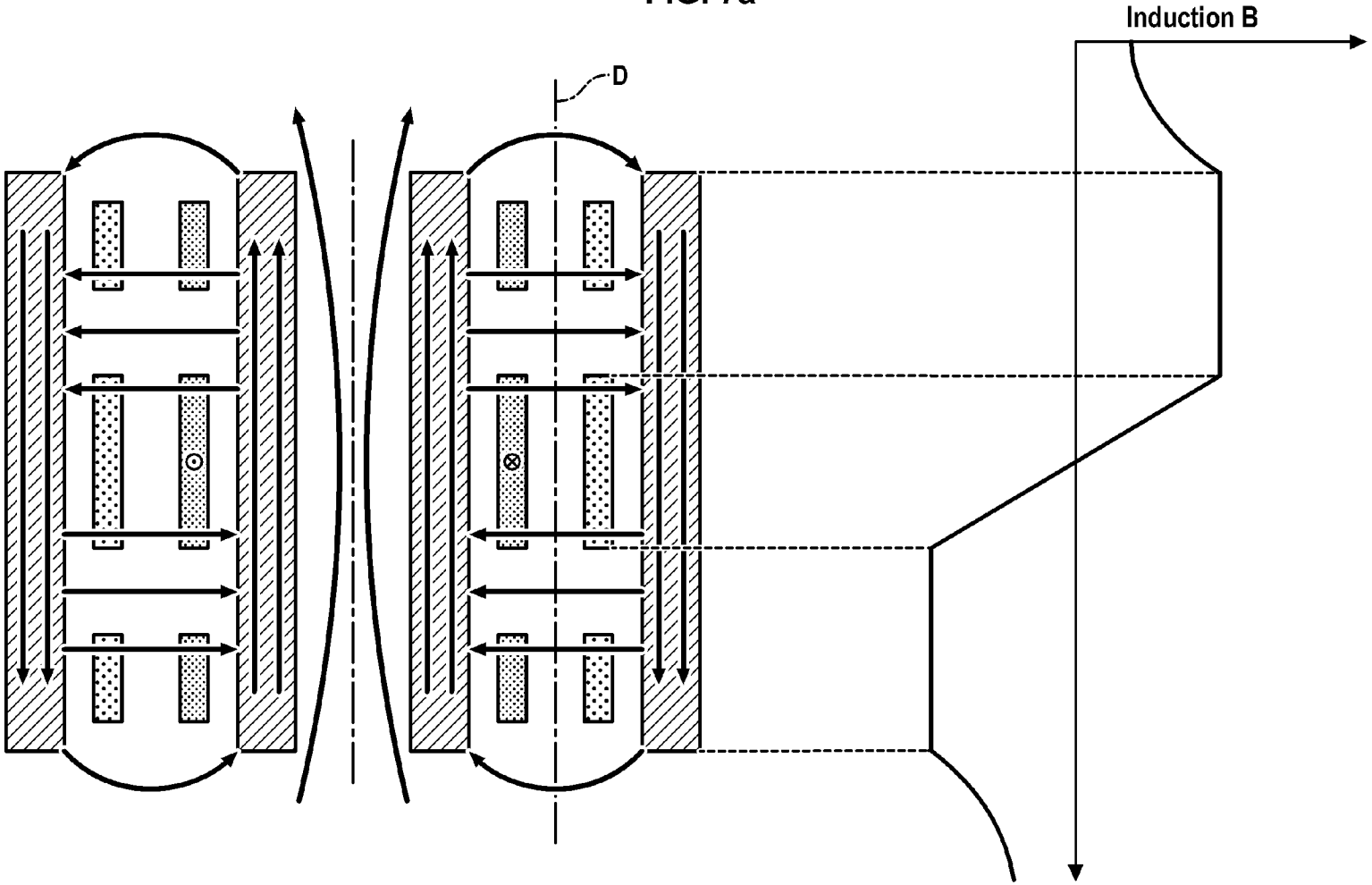
FIGS. 7*a* and 7*b* comprise sectional views of the transformer according to the first embodiment of the invention, and induction profiles along a straight line D obtained when specific and different windings of the transformer are supplied with current.
Figure 7B:
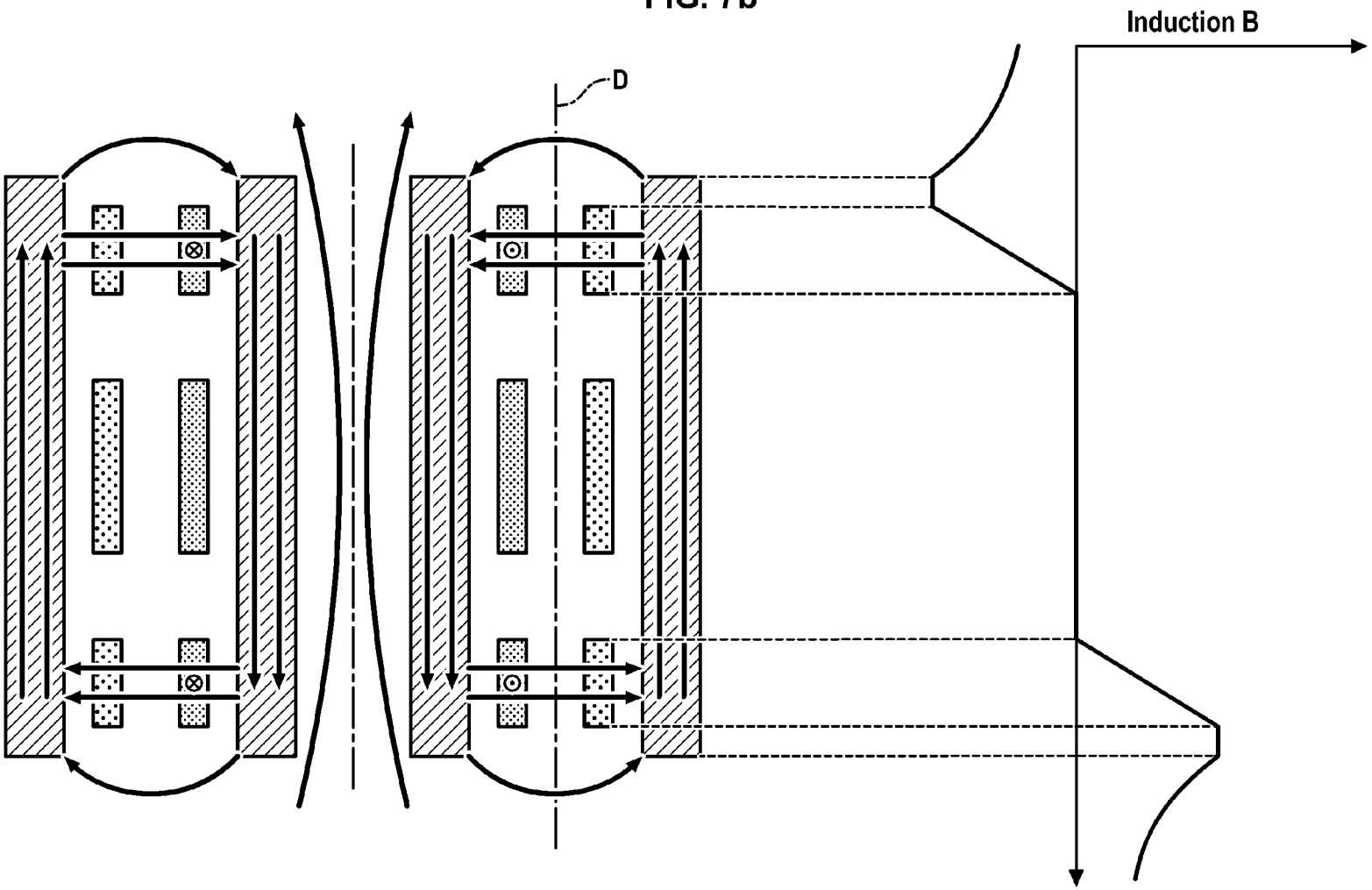

The compensation phenomenon of the inductions in the peripheral regions illustrated in the right part of FIG. 6 can be explained by way of FIGS. 7*a* and 7*b*. FIG. 7*a* shows the central magnetic induction obtained in the transformer T when the primary central winding 11*a* alone is supplied with current (the primary peripheral windings 12*a*, 13*a*, located on either side, being disconnected). FIG. 7*b* shows the magnetic inductions obtained in the transformer T when the primary peripheral windings 12*a*, 13*a* alone are supplied with current (the primary central winding 11*a* being disconnected). Superposing the magnetic inductions shown in FIGS. 7*a* and 7*b* produces the compensation phenomenon illustrated in the right part of FIG. 6 in the above peripheral regions.

It will be evident that the compensation phenomenon is not limited to the straight line D but is generalizable to the exterior of a bowl. Compensation occurs at any point in space farthest from this centre of the radius of the bowl, in all directions in space. The centre of the bowl is the intersection between the axis X and a plane intersecting the central conductors 11*a*, 11*b* in the particular embodiment in FIG. 6.

Because of this compensation phenomenon, magnetic leaks are avoided in the peripheral regions without having to resort absolutely to a magnetic circuit. However, even if this is no longer absolutely necessary, the transformer T can comprise such a magnetic circuit. The magnetic circuit is for example constituted by mu-metal (single sheet or stacked sheets (lamination)) or ferrite. In FIGS. 6, 7*a* and 7*b*, the magnetic circuit is formed by the casings 2*a* and 2*b*.

The magnetic circuit has two opposite ends having different positions along the axis X. Preferably, the primary and secondary windings are confined strictly between these two positions.

In other words, the magnetic circuit extends beyond the peripheral windings according to a direction parallel to the axis X. This improves the coupling between the windings of the transformer T.

"Planar" Embodiment

Figure 8:
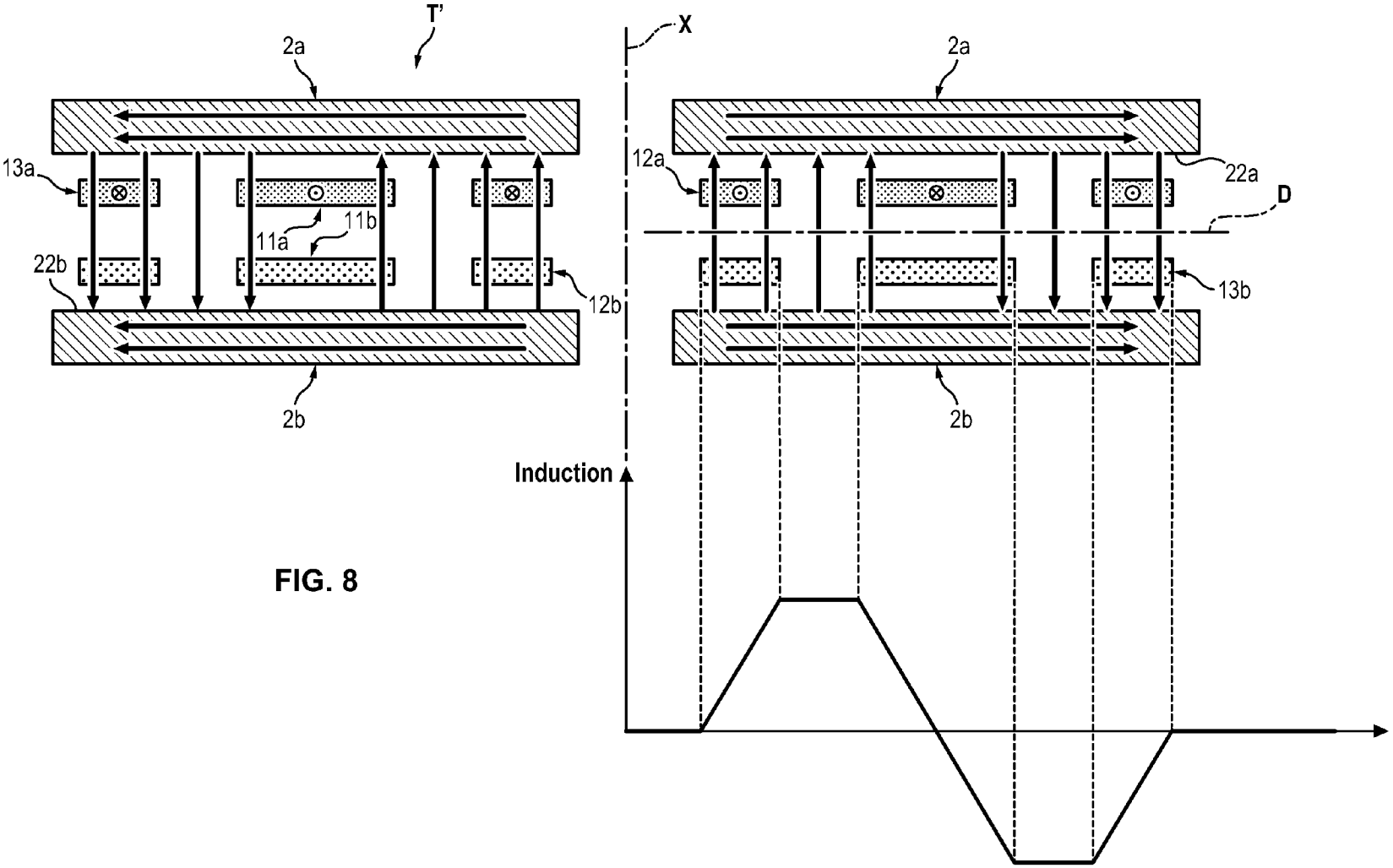
FIG. 8 comprises a longitudinal sectional view of a transformer according to a second embodiment of the invention, and an induction profile along a straight line D obtained when this transformer is supplied with current.

FIG. 8 schematically illustrates a transformer T' according to another embodiment, called "planar".

This embodiment differs from the embodiment with cylindrical windings in that the windings are arranged differently.

In this embodiment, each winding comprises at least one part in a spiral arranged transversally to the axis X, that is, each winding comprises several spirals wound around each other transversally to the axis X. The two ends of the part in a spiral have different radial positions relative to the axis X.

It is understood that a given winding can be constituted by a single spiral of several turns wound around each other, or can comprise several parts in spirals stacked on each other according to a stacking direction parallel to the axis X, each part in a spiral comprising several turns wound around the others.

A variant embodiment, particularly simple but non-limiting, in which each winding has a form of a planar spiral extending perpendicularly to the axis X will be considered hereinbelow.

The primary windings 11*a*, 12*a*, 13*a* are coplanar. The secondary windings 11*b*, 12*b*, 13*b* are also coplanar.

Each primary winding 11*a*, 12*a*, 13*a* is located in an annular sector around the axis X which is specific to it, the annular sectors being located in ranges of different radial positions relative to the reference axis X.

The transformer T' can also comprise a magnetic circuit. The magnetic circuit is for example constituted by mu-metal (single sheet or stacked sheets (lamination)) or ferrite. The magnetic circuit is for example formed by the casings 2*a* and 2*b*.

Figure 9:
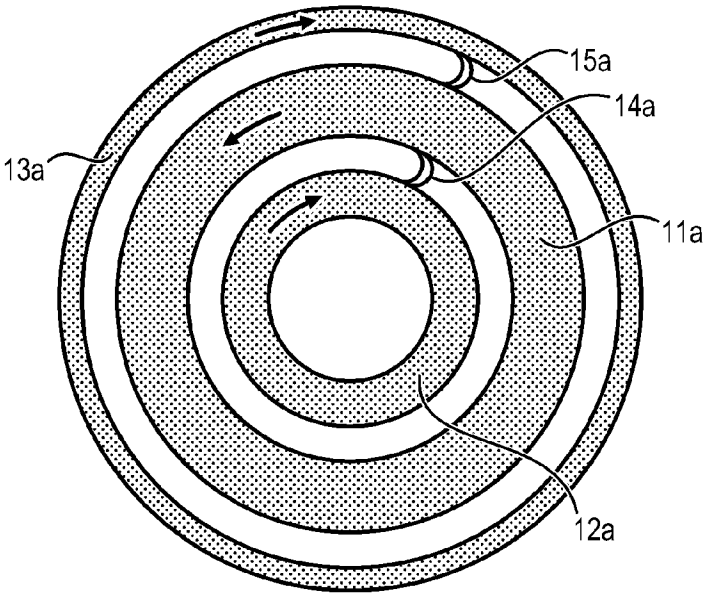
FIG. 9 is a transversal sectional view of the transformer of FIG. 8 detailing primary windings.

In reference to FIG. 9 (in a plane perpendicular to the axis X), the primary peripheral winding 13*a* is located in an external annular sector, and the primary central winding 11*a* is located in an intermediate annular sector, closer to the reference axis X than the external annular sector, and the primary peripheral winding 12*a* is located in an internal annular sector, closer to the axis X than the intermediate annular sector.

In this embodiment, the junction 14*a* between the primary winding 11*a* and the primary winding 12*a* is a portion of the primary conductor in a hairpin. This portion 14*a* can be rectilinear or curved (for example in U-shape). The same applies for the junction 15*a* which connects the primary windings 11*a* and 13*a*.

The three annular sectors can be contiguous in pairs. In other terms, the windings are in contact two by two (the junctions 14*a* and 15*a* can form a simple fold).

Alternatively, the three primary windings are at a distance from each other; in this case the junction 14*a* traverses an annular space between the two windings 11*a* and 12*a*, and the junction 15*a* traverses an annular space between the two windings 11*a* and 13*a*.

In the planar embodiment, a way of optimizing the compensation phenomenon is to ensure that the two annular spaces traversed by the junctions 14*a* and 15*a* have approximately the same area in a plane perpendicular to the axis X.

The primary windings 11*a*, 12*a*, 13*a* can be made on a plate in the shape of a washer (or "galette") centred on the axis X. The plate is for example constituted by electrically insulating material such as epoxy.

All the above applies also to the secondary windings 11*b*, 12*b*, 13*b* (replacing "a" by "b" in the references mentioned in the preceding paragraphs relating to FIG. 8).

Each secondary winding 11*b*, 12*b*, 13*b* is arranged opposite a primary winding 11*a*, 12*a*, 13*a*, according to a direction parallel to the axis X.

The transformer according to the "planar" embodiment can also be of rotary type.

The two casings 2*a*, 2*b* exhibit two annular surfaces 22*a*, 22*b* opposite each other, which extend in two parallel planes offset from each other along the reference axis X.

The primary windings 11*a*, 12*a*, 13*a* are fixed to the annular surface 22*a* of the primary casing 2*a*, and the secondary windings 11*b*, 12*b*, 13*b* are fixed to the annular surface 22*b* of the secondary casing 2*b*, opposite. Each primary winding is opposite a secondary winding, and this is irrespective of the angular position of the rotor when it is turning relative to the stator around the reference axis X.

The induction compensation phenomenon, already described for the transformer T with "cylindrical" windings, also occurs in the planar transformer T', when the primary windings 11*a*, 12*a*, 13*a* are supplied with current. An induction profile in FIG. 8 along a straight line D extending radially (perpendicularly) to the axis X is shown by way of example.

The compensation can be optimized by dissymmetrizing some parameters linked to the peripheral windings (number of turns, dimensions, spacing . . . ) as these peripheral windings are by nature dissymmetrical (the average radii are different).

In this embodiment, the central region is located between two concentric spheres: a first sphere and a second sphere enclosing the first sphere. The peripheral regions where induction is eliminated comprise:

- a region in the form of a bowl centred on the axis X and delimited by the first sphere,
- an external region further away from the axis X than the windings (therefore of infinite dimensions and going towards the exterior of the transformer), which is delimited internally by the second sphere.

This embodiment is particularly advantageous when items of equipment sensitive to magnetic radiation must be arranged along the reference axis X, in the region in the form of a bowl.

The transformer T' can also comprise a magnetic circuit. The magnetic circuit is for example formed by the casings 2*a*, 2*b* which extend radially relative to the axis X.

The magnetic circuit has two opposite ends having different radial positions relative to the axis X. Preferably, the primary and secondary windings occupy a space whereof the ends are strictly confined between and at a distance from these two radial positions. In other words, the magnetic circuit extends beyond the peripheral windings according to a direction radial to the axis X. This improves coupling between the windings of the transformer T'.

Also, the form in a spiral planar of the windings results in different cross-sections offered to the magnetic flux passing through the turns. This results in a differential flux which closes again outside the transformer T'.

Figure 10:
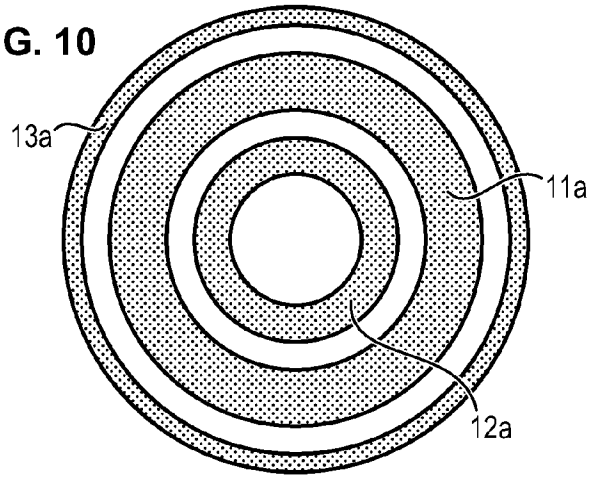
FIGS. 10 and 11 show other primary windings seen transversally.

A first option for improving the reduction in magnetic leaks is to opt for distribution of the number of different turns of the distribution n/4, n/2 and n/4, between the inner side and the outer side (see FIG. 10), so that the peripheral inductions compensate the central induction exactly.

Figure 11:
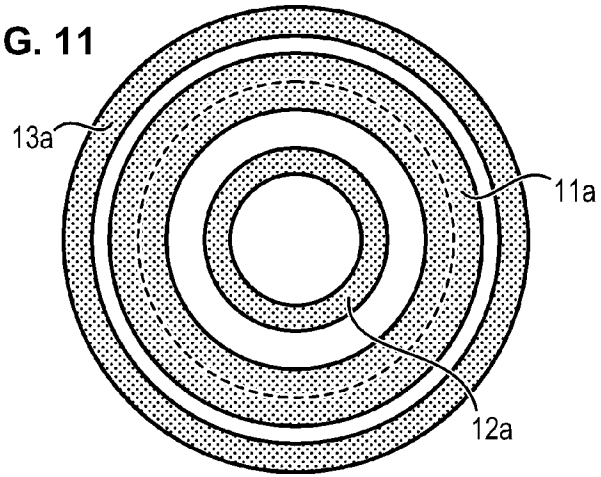

Another option consists of spacing the windings variously, according to FIG. 11.

The invention is not limited to the embodiments which have just been described. In particular:

The transformer is not necessarily of rotary type (in other terms, the parts A and B are not necessarily mobile relative to each other, but can be fixed relative to each other).

The positioning of the stator and of the rotor can be reversed.

Each winding can be supplied with current independently of the other windings.

The winding direction of the turns of the primary windings around the axis X is not necessarily alternating. In fact, to obtain the preferred induction compensation phenomenon it is enough that the currents which circulate in the primary peripheral windings are of direction opposite the current which circulates in the primary central winding. The same applies for the secondary windings.

Two adjacent windings (primary or secondary) are connected together by two immediately adjacent end turns, effectively reducing the length of the junction between two adjacent windings with a simple hairpin. As a variant, more complex junctions can be provided between two adjacent windings.

The invention claimed is:

1. An electrical transformer comprising:

a primary central winding extending around an axis and configured to generate a central magnetic flux when a turning current passes through the primary central winding according to a first direction around the axis, two primary peripheral windings extending around the axis, between which the primary central winding is located, and configured to generate central magnetic fluxes when respective turning currents pass through the two primary peripheral windings according to a second direction around the axis which is opposite the first direction, such that the central magnetic fluxes superpose on the central magnetic flux, wherein the windings are further configured such that the central magnetic fluxes compensate the central magnetic flux in regions located beyond the peripheral windings.

2. The transformer according to claim 1, wherein the primary windings are mounted in series.

3. The transformer according to claim 1, wherein:

the primary central winding is wound around the axis according to a first winding direction, the primary peripheral windings are wound around the axis according to a second winding direction opposite the first winding direction.

4. The transformer according to claim 1, wherein the primary peripheral windings together have an accumulated number of turns equal to a number of turns of the primary central winding.

5. The transformer according to claim 1, wherein each primary winding has at least one helicoidal part around and along the axis, wherein the helicoidal parts of the three primary windings extend in ranges of different respective positions along the axis.

6. The transformer according to claim 5, further comprising a magnetic circuit having two opposite ends having different longitudinal positions in a direction parallel to the axis, and wherein the primary windings are confined between and at a distance from these two longitudinal positions.

7. The transformer according to claim 1, wherein each primary winding has at least one part in a spiral wound on itself transversally to the axis, the parts in a spiral of the three primary windings extending in ranges of different respective annular positions relative to the axis.

8. The transformer according to claim 7, wherein the primary windings are coplanar.

9. The transformer according to claim 7, further comprising a magnetic circuit having two opposite ends having different radial positions in a direction perpendicular to the axis, and wherein the primary and secondary windings are confined between and at a distance from these two radial positions.

10. The electrical transformer according to claim 1, further comprising:

a secondary central winding configured to receive at least in part the central magnetic flux.

11. The electrical transformer according to claim 10, further comprising:

two secondary peripheral windings, between which the secondary central winding is located, wherein each secondary peripheral winding is configured to receive at least partially one of the central magnetic fluxes.

12. The transformer according to claim 10, comprising a primary casing to which each primary winding is fixed, and a secondary casing to which the or each secondary winding is fixed, wherein the two casings are mobile in rotation relative to each other relative to the axis.

13. The transformer according to claim 10, further comprising:

a primary casing presenting a primary annular surface extending perpendicularly to the axis, wherein each primary winding is fixed on the primary annular surface, a secondary casing presenting a secondary annular surface extending perpendicularly to the axis and facing the primary annular surface, wherein each secondary winding is fixed on the secondary annular surface so as to be opposite a primary winding.

* * * * *